US010081514B2

(12) United States Patent
Lee et al.

(10) Patent No.: US 10,081,514 B2
(45) Date of Patent: Sep. 25, 2018

(54) ELEVATOR AUTOMATIC GUIDE ASSISTANT SYSTEM AND GUIDE METHOD

(71) Applicant: HON HAI PRECISION INDUSTRY CO., LTD., New Taipei (TW)

(72) Inventors: Horng-Juing Lee, New Taipei (TW); Tien-Ping Liu, New Taipei (TW); I-Hao Chung, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 9 days.

(21) Appl. No.: 15/294,769

(22) Filed: Oct. 16, 2016

(65) Prior Publication Data

US 2017/0183198 A1 Jun. 29, 2017

(30) Foreign Application Priority Data

Dec. 29, 2015 (TW) ..... 104144201 A

(51) Int. Cl.

| | |
|---|---|
| ***B66B 1/16*** | (2006.01) |
| ***B66B 3/00*** | (2006.01) |
| ***B66B 1/34*** | (2006.01) |
| ***B66B 1/46*** | (2006.01) |
| ***B66B 5/00*** | (2006.01) |

(52) U.S. Cl.

CPC ..... *B66B 3/006* (2013.01); *B66B 1/3446* (2013.01); *B66B 1/468* (2013.01); *B66B 5/0018* (2013.01); *B66B 2201/4653* (2013.01)

(58) Field of Classification Search

CPC ..... B66B 3/008; B66B 3/00; B66B 3/006; B66B 3/002; B66B 1/24; B66B 1/3415; B66B 2201/463; B66B 1/468; B66B 2201/4653; B66B 1/3446; B66B 2201/103; B66B 2201/4669; B66F 9/0755; B66F 9/24

See application file for complete search history.

(56) References Cited

U.S. PATENT DOCUMENTS

| | | | | |
|---|---|---|---|---|
| 5,554,832 | A * | 9/1996 | Lumme | B66B 1/468 187/380 |
| 8,744,754 | B2 * | 6/2014 | Kappeler | B66B 1/468 187/391 |
| 8,880,200 | B2 * | 11/2014 | Nowel | B66B 1/468 187/247 |
| 2004/0262093 | A1 * | 12/2004 | Forsythe | B66B 1/34 187/391 |

(Continued)

*Primary Examiner* — Marlon Fletcher
(74) *Attorney, Agent, or Firm* — ScienBiziP, P.C.

(57) ABSTRACT

An elevator automatic guide assistant system comprises a user assistant system, an elevator outside assistant system, and an elevator inside assistant system. The user assistant system is configured to send a taking elevator instruction and target floor information to the elevator outside assistant system, receive and send the feedback information to a user. The elevator outside assistant system is configured to guide the user to arrive at an elevator doorway. The elevator inside assistant system is configured to send floor information to the elevator outside assistant system and the user assistant system, receive instructions from the user assistant system, and guide the user to arrive at the target floor. The present disclosure relates also to a guide method of the elevator automatic guide assistant system.

18 Claims, 2 Drawing Sheets

(56) References Cited

U.S. PATENT DOCUMENTS

| | | | | |
|---|---|---|---|---|
| 2007/0151809 | A1* | 7/2007 | Tyni | B66B 1/468 187/391 |
| 2008/0067013 | A1* | 3/2008 | Ylinen | B66B 1/34 187/382 |
| 2012/0279808 | A1* | 11/2012 | Terry | B66B 1/468 187/388 |
| 2014/0305747 | A1* | 10/2014 | Kumar | B66B 1/468 187/381 |
| 2014/0339023 | A1* | 11/2014 | Friedli | B66B 1/2408 187/247 |
| 2016/0009525 | A1* | 1/2016 | DePaola | B66B 1/468 187/380 |
| 2016/0376124 | A1* | 12/2016 | Bunter | B66B 1/468 187/247 |

* cited by examiner

ELEVATOR AUTOMATIC GUIDE ASSISTANT SYSTEM AND GUIDE METHOD

CROSS-REFERENCE TO RELATED APPLICATIONS

This application claims all benefits accruing under 35 U.S.C. § 119 from Taiwan Patent Application No. 104144201, filed on Dec. 29, 2015, in the China Intellectual Property Office, the disclosure of which is incorporated herein by reference.

FIELD

The present disclosure relates to an elevator automatic guide assistant system and a guide method.

BACKGROUND

There are light, sound, and signboard to guide user to take the elevator. A floor indicator light is located in a floor indicator button in the elevator. When the floor indicator button shows selected floor, the floor indicator light is on. The user enters the elevator, and presses the floor indicator button to select floor, this moment the floor indicator light is on. When reaching the selected floor, the floor indicator light is off. However, the elevator's operation is not applicable for blind person, because blind person cannot see the floor indicator button and the floor indicator light. It is difficult for the blind persons or robots to take the elevator alone.

What is needed, therefore, is to provide an elevator automatic guide assistant system and a guide method that can overcome the above-described shortcomings.

BRIEF DESCRIPTION OF THE DRAWINGS

Implementations of the present technology will now be described, by way of example only, with reference to the attached figures, wherein.

DETAILED DESCRIPTION

Figure 1:
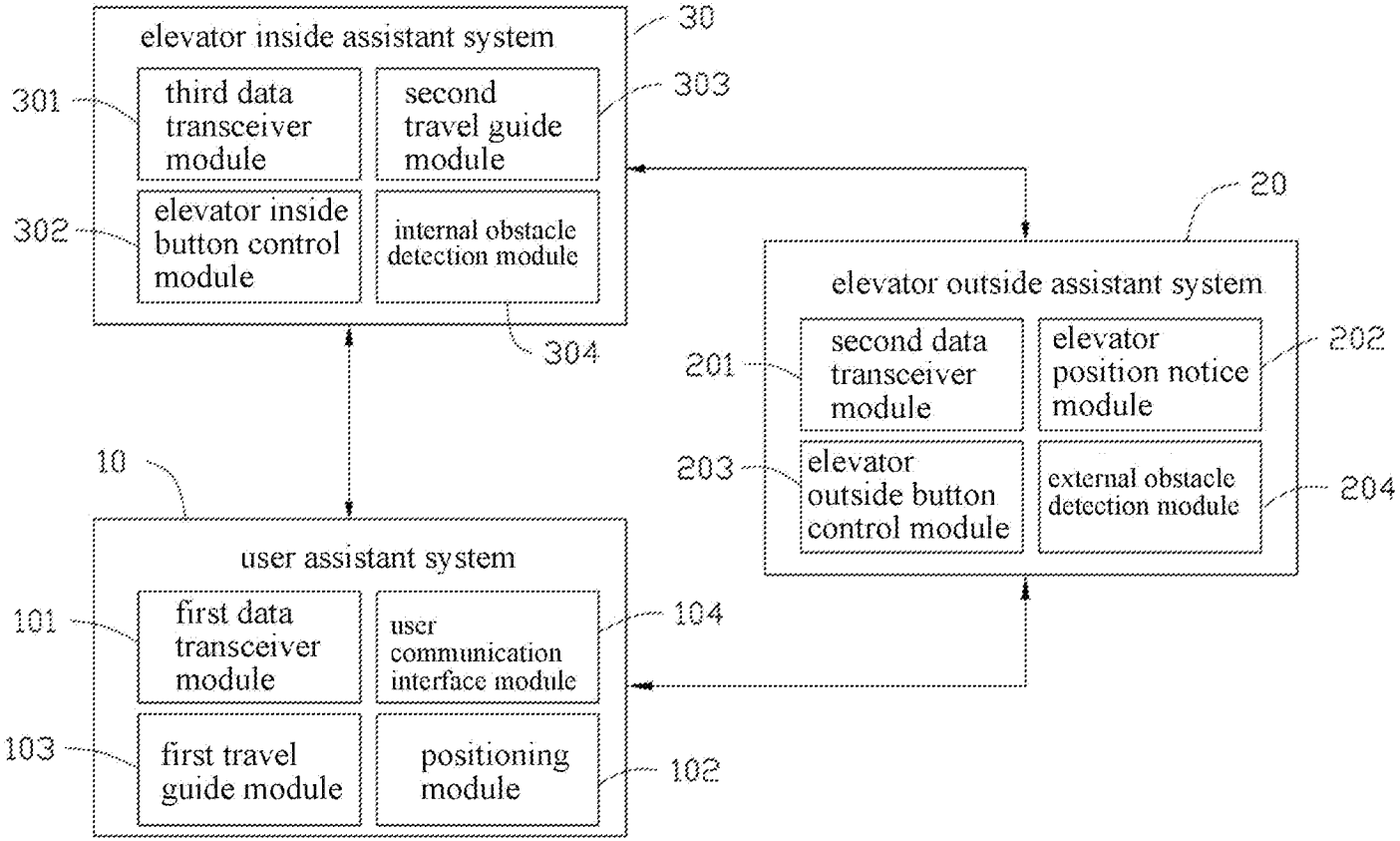
FIG. 1 is a schematic view of an embodiment of an elevator automatic guide assistant system.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Referring to FIG. 1, an embodiment of an elevator automatic guide assistant system 100 includes a user assistant system 10, an elevator outside assistant system 20, and an elevator inside assistant system 30.

The user assistant system 10 is used to send instructions to the elevator outside assistant system 20, and receive feedback information from the elevator outside assistant system 20. Thus, the user is guided to be near to the elevator. The elevator outside assistant system 20 is used to cooperate with the user assistant system 10 to guided the user to arrive at the elevator doorway. The elevator inside assistant system 30 is used to send floor information to the elevator outside assistant system 20 and the user assistant system 10, and receive the instructions from the user assistant system 10 when the user arrives at selected floor.

The user assistant system 10 includes a first data transceiver module 101, a positioning module 102, a first travel guide module 103, and a user communication interface module 104.

The first data transceiver module 101 is configured to communicate with the elevator outside assistant system 20 and the elevator inside assistant system 30. In detail, the first data transceiver module 101 is configured to send information to the elevator outside assistant system 20 and the elevator inside assistant system 30, and receive feedback information from the elevator outside assistant system 20 and the elevator inside assistant system 30. The first data transceiver module 101 can be a Zigbee module, a Bluetooth module, a WIFI module, or any combination thereof. For example, the Zigbee module can be a Xbee Pro S2B 63 mW wireless network module, and the Bluetooth module can be a Bluetooth HC-06 module.

The positioning module 102 is used to determine the user's location, process the information of the user's location and the feedback information received by the first data transceiver module 101, and form navigation information. The navigation information is sent to the first travel guide module 103 by the positioning module 102, so that the user is guided to specified location. Meanwhile, the positioning module 102 send real time location information to the first travel guide module 103, the elevator outside assistant system 20 and the elevator inside assistant system 30 by the first data transceiver module 101. The positioning module 102 can be a locator, an infrared probe, a camera, a WIFI module, and so on. The locator can be a GPS locator, a Glonass locator, a Galileo locator, and so on.

The first travel guide module 103 is used to receive the navigation information, and guide and drive the user to move under the guiding of the navigation information. The first travel guide module 103 includes at least three receivers, such as a left receiver, a central receiver, and a right receiver. The receiver can be an infrared receiver, a ultrasonic receiver, a RFID identifier, a two-dimensional code scanner, or any combination thereof.

In one embodiment, the first travel guide module 103 includes three infrared receivers, and the three infrared receivers are respectively a left infrared receiver, a central infrared receiver, and a right infrared receiver. The left infrared receiver, the central infrared receiver, and the right infrared receiver are separated from each other and located on the user. The left infrared receiver is located on the user's left side, such as left arm. The central infrared receiver is located on the user's middle, such as chest. The right infrared receiver is located on the user's right side, such as right arm. In one embodiment, the first travel guide module 103 including the left infrared receiver, the central infrared receiver, and the right infrared receiver is used to guide the user to walk into the elevator. The left infrared receiver, the central infrared receiver, and the right infrared receiver are used to assist the user to move according to the established route. Three infrared emitters, such as a left infrared emitter, a central infrared emitter, and a right infrared emitter, are fixed on the elevator outside assistant system 20. The three infrared receivers and the three infrared emitters match with each other, to guide the user to accurately enter the elevator. In detail, when the central infrared receiver receives the signal emitted by the central infrared emitter, it can be judged that the user goes ahead; when the left infrared receiver receives the signal emitted by the central infrared emitter, it can be judged that the user goes to the right. The user is guided to go along the correct route according to the instruction of the first travel guide module 103. And so on, the user is guided to go along the correct route and arrive at the door of the elevator outside assistant system 20.

The user communication interface module 104 is used to communicate with the user, receive the instructions from the user, and feed back the instructions received by the user assistant system 10 to the user. The user communication interface module 104 includes a display module, a sound module, and a vibration module. The display module can be a touch display module used to receive the instructions from the user. In detail, the user touches the touch display module and gives instructions of taking the elevator and arriving the target floor. At the same time, the sound module tells the user that the instructions of taking the elevator and arriving the target floor have been given. The instructions received by the user assistant system 10 are feed backed to the user in the form of sound. At the same time, when the user assistant system 10 receives the instructions, the vibration module can vibrate, the user thus is reminded.

The elevator outside assistant system 20 includes a second data transceiver module 201, an elevator position notice module 202, an elevator outside button control module 203, and an external obstacle detection module 204. The second data transceiver module 201 is used to communicate with the user assistant system 10 and the elevator inside assistant system 30. The elevator position notice module 202 is used to obtain the current floor information and the elevator position information, and send the current floor information and the elevator position information to the user assistant system 10 and the elevator inside assistant system 30. The elevator outside button control module 203 is used to receive instructions of taking the elevator from the user assistant system 10, such as, "up" or "down". The elevator outside button control module 203 can instruct the elevator door to be open or close, and let the user safely enter and get off the elevator. The external obstacle detection module 204 is used to determine whether the elevator door is open, determine the user congestion situation, and send related information to the user assistant system 10 through the second data transceiver module 201. The external obstacle detection module 204 can be located on the outside of the elevator door.

The external obstacle detection module 204 can include many human body detection modules and obstacle detection modules. The human body detection module can be an infrared human body detection module, such as human body infrared thermal release motion sensor with the sensing angle of about 100 degrees and the sensing distance of about 7 meters. The human body infrared thermal release motion sensor can detect the number of the users and the congestion situation in the range of 7 meters, and send detected information to the user assistant system 10. The obstacle detection module can be an ultrasonic detection module with the sensing angle of less than and equal to 15 degrees, with the sensing distance of about 2 centimeters to about 450 centimeters, and with accuracy of about 0.3 centimeters. The ultrasonic detection module can detect the number of the users and the congestion situation in the range of 50 meters, and send detected information to the user assistant system 10.

The elevator inside assistant system 30 includes a third data transceiver module 301, an elevator inside button control module 302, a second travel guide module 303, and an internal obstacle detection module 304. The third data transceiver module 301 is used to communicate with the first data transceiver module 101 and the second data transceiver module 201. The information from the first data transceiver module 101 and the second data transceiver module 201 is send to the elevator inside button control module 302, the second travel guide module 303, and the internal obstacle detection module 304 by the third data transceiver module 301.

The third data transceiver module 301 is used to receive information from the user assistant system 10, send the floor where the user is located and the correct elevator information to the user assistant system 10 and the elevator outside assistant system 20, and send related instructions to the elevator inside button control module 302. The user thus is guided to arrive at the elevator door. At the same time, the third data transceiver module 301 sends information of already arriving at the target floor to the user assistant system 10, to remind the user the to get off the elevator. The elevator inside button control module 302 receives the instructions from the third data transceiver module 301, and instruct the elevator to arrive at the floor where the user is located. In detail, when the user closes to the elevator, the elevator inside button control module 302 instructs the elevator door to be open; when the user enters the elevator, the elevator inside button control module 302 instructs the elevator door to be close; when the user arrives at the target floor, the elevator inside button control module 302 instructs the elevator door to be open again. Furthermore, the elevator inside button control module 302 can instruct the elevator door to delay to be close or open again according to need, avoiding clamping the user.

The internal obstacle detection module 304 is used to detect whether there is enough space inside of the elevator, whether overweight, or whether a barrier blocks the elevator door. And then, the internal obstacle detection module 304 send information, such as, going forward, waiting, backing off, and taking the next elevator, to the user assistant system 10 by the third data transceiver module 301. The user thus is guided to go forward, wait, or back off, and safely enter and get off the elevator. The internal obstacle detection module 304 includes an infrared module, a ultrasonic module, a RFID module, or any combination thereof. In one embodiment, the internal obstacle detection module 304 includes the infrared module and the ultrasonic module. The infrared module is a human body infrared thermal release motion sensor (SEN171) with the sensing angle of about 100 degrees and the sensing distance of about 7 meters. The human body infrared thermal release motion sensor can be located at the top of the stairs. The ultrasonic module is a HC-SR04 ultrasonic sensor with the sensing angle of less than and equal to 15 degrees, with the sensing distance of about 2 centimeters to about 450 centimeters, and with accuracy of about 0.3 centimeters. The ultrasonic module can detect the number of the users and the congestion situation in the range of 50 meters. The ultrasonic module can be located inside of the elevator.

The second travel guide module 303 is used to guide the user enters or get off the elevator according to the detected result of the internal obstacle detection module 304. The second travel guide module 303 and the first travel guide module 103 cooperate with each other to guide the user to arrive at the target position in the elevator. In detail, the second travel guide module 303 includes three infrared emitters, such as a left infrared emitter, a central infrared emitter, and a right infrared emitter, fixed on the inside of the elevator. The three infrared emitters in the second travel guide module 303 and the three infrared emitters in the first travel guide module 103 cooperate with each other, to guide the user to accurately enter the elevator. It is understood that the second travel guide module 303 can be a RFID emitter or a two-dimensional code generator. The RFID emitter or the two-dimensional code generator in the second travel guide module 303 and the RFID identifier or a two-dimensional code scanner in the first travel guide module 103 can cooperate with each other, to accurately detect the user's position.

Figure 2:
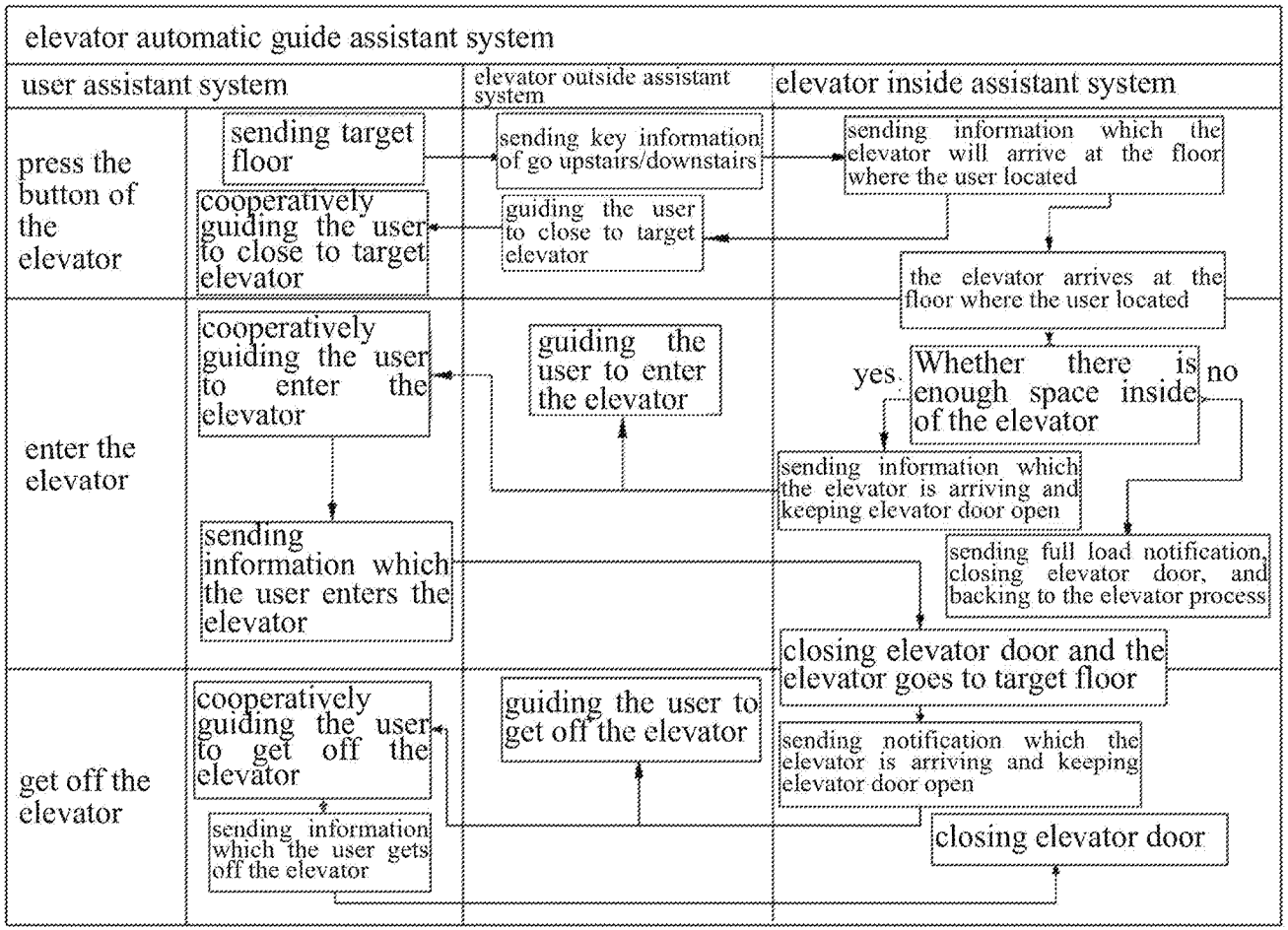
FIG. 2 is a flowchart of a guide method of the elevator automatic guide assistant system of FIG. 1.

Referring to FIG. 2, a guide method of the elevator automatic guide assistant system 100 includes the following steps:

S1, giving a taking elevator information of a user and a target floor information of a target floor that the user want to arrive by the user assistant system 10;

S2, receiving the taking the elevator information and the target floor information, and sending a key information of go upstairs/go downstairs by the elevator outside assistant system 20;

S3, defining a floor which the user is located as an original floor, sending target elevator information of a target elevator which will arrive at the original floor soon, to the user assistant system 10 by the elevator inside assistant system 30;

S4, making the user assistant system 10 arrive at a designated elevator doorway of the target elevator;

S5, after the target elevator being arrived, detecting whether there is enough space inside of the target elevator by the elevator inside assistant system 30; when there is not enough space inside of the target elevator, closing an elevator door and sending a waiting information to the user assistant system 10; when there is enough space inside of the target elevator, opening the elevator door and sending an elevator door opening information to the user assistant system 10, and guiding the user to enter the target elevator;

S6, detecting whether the user enters the target elevator by the elevator inside assistant system 30; when the user does not enter the target elevator, keeping the target elevator door open; when the user enters the target elevator, sending a closing elevator door information by the elevator inside assistant system 30, and instructing the target elevator to go to the target floor;

S7, detecting whether the target elevator arrives at the target floor by the elevator inside assistant system 30; when the target elevator arrives at the target floor, opening the elevator door and sending an arriving information to the user assistant system 10 and the elevator outside assistant system 20;

S8, guiding the user to get off the target elevator under cooperation of the user assistant system 10, the elevator outside assistant system 20, and the elevator inside assistant system 30; and S9, sending an information that the user gets off the target elevator to the elevator outside assistant system 20 and the elevator inside assistant system 30 by the user assistant system 10, and closing the elevator door.

The elevator automatic guide assistant system 100 can cooperate with the sensor, wireless transmission, and software controller, conveniently and accurately guiding special user to take the elevator. The guide method can save the user's waiting time and ensure the safety of the user.

Finally, it is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure.

Depending on the embodiment, certain of the steps of methods described may be removed, others may be added, and the sequence of steps may be altered. The description and the claims drawn to a method may include some indication in reference to certain steps. However, the indication used is only to be viewed for identification purposes and not as a suggestion as to an order for the steps.

What is claimed is:

1. An elevator automatic guide assistant system comprising:

an user assistant system;

an elevator outside assistant system connected to the user assistant system; and an elevator inside assistant system connected to the user assistant system;

wherein the user assistant system is configured to send a taking elevator instruction and target floor information to the elevator outside assistant system, and receive feedback information from the elevator outside assistant system and the elevator inside assistant system; the elevator outside assistant system is configured to guide a user to arrive at an elevator doorway; the elevator inside assistant system is configured to send target elevator information of a target elevator which will arrive at an original floor, wherein the original floor is that the user is located, to the elevator outside assistant system and the user assistant system; the user assistant system comprising:

a first data transceiver module configured to communicate with the elevator outside assistant system and the elevator inside assistant system;

a positioning module configured to determine a position of the user and form navigation information;

a first travel guide module configured to guide the user to move under the navigation information; and a user communication interface module configured to communicate with the user.

2. The elevator automatic guide assistant system of claim 1, wherein the positioning module comprises a locator, an infrared probe, a camera, a WIFI module, or any combination thereof; the first travel guide module comprises a left receiver, a central receiver, and a right receiver; and the user communication interface module comprises a display module, a sound module, and a vibration module.

3. The elevator automatic guide assistant system of claim 1, wherein the elevator outside assistant system comprises a second data transceiver module, an elevator position notice module, an elevator outside button control module, and an external obstacle detection module.

4. The elevator automatic guide assistant system of claim 3, wherein the second data transceiver module is configured to communicate with the user assistant system and the elevator inside assistant system; the elevator position notice module is configured to send current floor information and current elevator position information to the user assistant system and the elevator inside assistant system; the elevator outside button control module is configured to receive the taking elevator instruction, and instruct an elevator door to be open or close; and the external obstacle detection module is configured to determine whether the elevator door is open.

5. The elevator automatic guide assistant system of claim 3, wherein the external obstacle detection module comprises a plurality of human body detection modules and a plurality of obstacle detection modules.

6. The elevator automatic guide assistant system of claim 1, wherein the elevator inside assistant system comprises a third data transceiver module, an elevator inside button control module, a second travel guide module, and an internal obstacle detection module.

7. The elevator automatic guide assistant system of claim 6, wherein the internal obstacle detection module is configured to detect whether there is enough space inside of the target elevator, whether the target elevator is overweight, or whether a barrier blocks an elevator door of the target elevator.

8. The elevator automatic guide assistant system of claim 1, wherein the elevator inside assistant system comprises a second travel guide module, and the second travel guide module and the first travel guide module cooperate with each other, to guide the user to enter or get off the target elevator.

9. A guide method comprising:

S1, providing an elevator automatic guide assistant system comprising a user assistant system, an elevator outside assistant system, and an elevator inside assistant system;

S2, giving taking elevator information and target floor information by the user assistant system;

S3, receiving the taking elevator information and the target floor information, and sending a key information of go upstairs/go downstairs by the elevator outside assistant system;

S4, defining a floor which a user is located as an original floor, sending a target elevator information which an elevator will arrive at the original floor, to the user assistant system by the elevator inside assistant system;

S5, making the user assistant system arrive at a designated elevator doorway according to the target elevator information;

S6, after a target elevator is coming, detecting whether there is enough space inside of the target elevator by the elevator inside assistant system; when there is not enough space inside of the target elevator, closing an elevator door and sending a waiting information to the user assistant system; when there is enough space inside of the target elevator, opening the elevator door and sending an elevator door opening information to the user assistant system, and guiding the user to enter the target elevator;

S7, detecting whether the user enters the target elevator by the elevator inside assistant system; when the user does not enter the target elevator, keeping the elevator door open; when the user enters the target elevator, sending a closing elevator door information by the elevator inside assistant system, and instructing the target elevator to go to a target floor;

S8, detecting whether the target elevator arrives at the target floor by the elevator inside assistant system; when the target elevator arrives at the target floor, opening the elevator door and sending an arriving information to the user assistant system and the elevator outside assistant system;

S9, guiding the user to get off the target elevator; and

S10, sending an information which the user gets off the target elevator to the elevator outside assistant system and the elevator inside assistant system by the user assistant system, and closing the elevator door.

10. An elevator automatic guide assistant system comprising:

an user assistant system;

an elevator outside assistant system connected to the user assistant system; and an elevator inside assistant system connected to the user assistant system;

wherein the user assistant system is configured to send a taking elevator instruction and target floor information to the elevator outside assistant system, and receive feedback information from the elevator outside assistant system and the elevator inside assistant system; the elevator outside assistant system is configured to guide a user to arrive at an elevator doorway; the elevator inside assistant system is configured to send target elevator information of a target elevator which will arrive at an original floor, wherein the original floor is that the user is located, to the elevator outside assistant system and the user assistant system; and the user assistant system comprises a positioning module and a first travel guide module, the positioning module is configured to determine a position of the user and form navigation information, and the first travel guide module is configured to guide the user to move under the navigation information.

11. The elevator automatic guide assistant system of claim 10, wherein the user assistant system further comprises a first data transceiver module and a user communication interface module, the first data transceiver module is configured to communicate with the elevator outside assistant system and the elevator inside assistant system, and the user communication interface module is configured to communicate with the user.

12. The elevator automatic guide assistant system of claim 11, wherein the positioning module comprises a locator, an infrared probe, a camera, a WIFI module, or any combination thereof; the first travel guide module comprises a left receiver, a central receiver, and a right receiver; and the user communication interface module comprises a display module, a sound module, and a vibration module.

13. The elevator automatic guide assistant system of claim 10, wherein the elevator outside assistant system comprises a second data transceiver module, an elevator position notice module, an elevator outside button control module, and an external obstacle detection module.

14. The elevator automatic guide assistant system of claim 13, wherein the second data transceiver module is configured to communicate with the user assistant system and the elevator inside assistant system; the elevator position notice module is configured to send current floor information and current elevator position information to the user assistant system and the elevator inside assistant system; the elevator outside button control module is configured to receive the taking elevator instruction, and instruct an elevator door to be open or close; and the external obstacle detection module is configured to determine whether the elevator door is open.

15. The elevator automatic guide assistant system of claim 13, wherein the external obstacle detection module comprises a plurality of human body detection modules and a plurality of obstacle detection modules.

16. The elevator automatic guide assistant system of claim 10, wherein the elevator inside assistant system comprises a third data transceiver module, an elevator inside button control module, a second travel guide module, and an internal obstacle detection module.

17. The elevator automatic guide assistant system of claim 16, wherein the internal obstacle detection module is configured to detect whether there is enough space inside of the target elevator, whether the target elevator is overweight, or whether a barrier blocks an elevator door of the target elevator.

18. The elevator automatic guide assistant system of claim 10, wherein the elevator inside assistant system comprises a second travel guide module, and the second travel guide module and the first travel guide module cooperate with each other, to guide the user to enter or get off the target elevator.

* * * * *